US005349890A

United States Patent [19]

Butkus et al.

[11] Patent Number: 5,349,890

[45] Date of Patent: Sep. 27, 1994

[54] APPARATUS FOR SEVERING OFF PIECES FROM AN ENDLESS WEB

[75] Inventors: John J. Butkus, Woodbury; Paul R. Bird, Naugatuck, both of Conn.

[73] Assignee: Scovill Fasteners Inc., Clarkesville, Ga.

[21] Appl. No.: 127,134

[22] Filed: Sep. 27, 1993

Related U.S. Application Data

[63] Continuation of Ser. No. 979,064, Nov. 19, 1992, abandoned.

[51] Int. Cl.[5] ..... B26D 1/06; B26D 7/10

[52] U.S. Cl. ..... 83/171; 83/402; 83/639.1; 83/658

[58] Field of Search ..... 83/171, 402, 639.1, 83/658

[56] References Cited

U.S. PATENT DOCUMENTS

| | | | |
|---|---|---|---|
| 3,289,516 | 12/1966 | Bohrer et al. | 83/698 |
| 3,362,272 | 1/1968 | Grosse | 83/620 |
| 3,732,770 | 5/1973 | Ottavan | 83/658 |
| 3,874,975 | 4/1975 | Lagain | 83/171 |
| 4,215,607 | 8/1980 | Hudson et al. | 83/171 |
| 4,449,434 | 5/1984 | Johnson | 83/171 |
| 4,505,412 | 3/1985 | Reba | 83/402 |
| 4,693,701 | 9/1987 | deBin | 83/171 |
| 4,823,660 | 4/1989 | Forthmann | 83/171 |

FOREIGN PATENT DOCUMENTS

| | | | |
|---|---|---|---|
| 258457 | 10/1963 | Australia | 83/171 |
| 2300686 | 7/1974 | Fed. Rep. of Germany | 83/171 |

*Primary Examiner*—Hien H. Phan
*Attorney, Agent, or Firm*—Dallett Hoopes

[57] ABSTRACT

A heated knife has a motor adapted to drive the knife against a cutting block with the web inbetween. The knife body is metal and has a cutting edge with side surfaces at an obtuse angle to each other. The knife is formed with a lengthwise bore which houses a Calrod capable of heating the knife up to about 950° F. The knife body has relatively thin lateral ears spaced from the heater and which receive support bolts from the opposite ends of a driving yoke by which the motor drives the knife. This arrangement reduces the amount of heat withdrawn from the knife.

4 Claims, 2 Drawing Sheets

APPARATUS FOR SEVERING OFF PIECES FROM AN ENDLESS WEB

This is a Continuation, of application Ser. No. 07/979,064, filed Nov. 19, 1992, now abandoned.

BACKGROUND OF THE INVENTION

1. Field of the Invention

This invention relates to a severing apparatus for cutting off finite lengths of an endless web. More specifically, the invention relates to a reciprocable heated knife adapted to sever the web as it impacts against a cutting block with the web inbetween.

2. Description of Related Art Including Information Disclosed Under §§1.97 to 1.99

The prior art is replete with examples of knives used for severing measured lengths off of an endless web. Usually this is done by a shearing action wherein a reciprocable knife blade descends in shearing relation to a cutting edge mounted in the path of the web. It has been found that, in cutting certain woven or knitted material, the edge thus severed has a tendency to fray. Often it has been necessary to chemically treat the severed edge of fabric in order to soften it so that adjacent threads bind to each other and not fray. This has resulted in a stiff abrasive edge which has been undesirable, particularly in applications in the garment industry, such as infants clothing, wherein the end of the piece may come in contact with the skin.

SUMMARY OF THE INVENTION

The invention, therefore, provides a heated knife body and motor means adapted to drive the knife body against a cutting block or stick with the web inbetween. This apparatus is especially well suited to severing lengths of a synthetic web.

The knife body is metal and formed with a lengthwise bore which receives a Calrod capable of heating the knife up to about 950° F. The knife body bas relatively thin lateral ears which receive support bolts from the opposite ends of a driving yoke respectively. The yoke is centrally secured to a piston housed in a pneumatic cylinder.

BRIEF DESCRIPTION OF THE DRAWINGS

Further objects and features of the invention will be apparent to those skilled in the art from a reading of the following specification and reference to the drawings, all of which disclose a non-limiting embodiment of the invention. In the drawings.

DESCRIPTION OF THE PREFERRED EMBODIMENT

Figure 1:
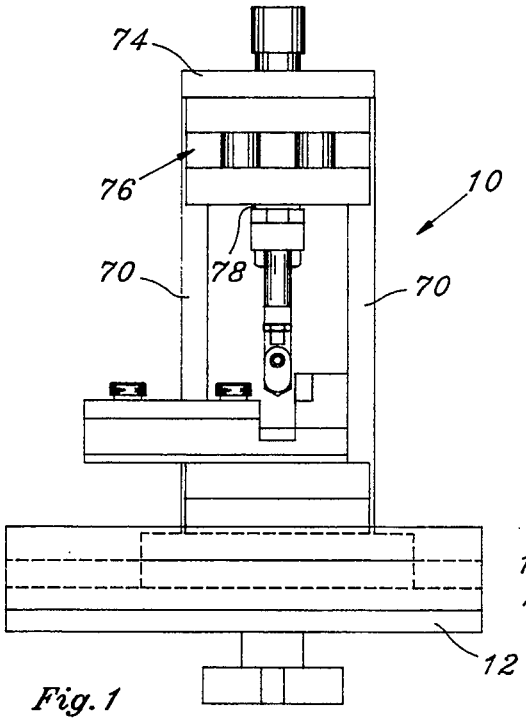
FIG. 1 is a side view of a severing apparatus embodying the invention. The side legs nearest the viewer are removed for visibility.

An apparatus embodying the invention is shown in FIG. 1 and generally designated 10. It comprises a U-shaped support 12 having sides 14 which are parallel and extend upward along the opposite sides of a base member 16. The base member is centrally slotted longitudinally as at 18 and the inside face of each of the side members 14 are grooved as at 20.

A bed including bottom plate 22 slides adjustably in the grooves 20 and has central threaded opening with an attaching bolt 24. The bolt extends through a spacer 26 and the slot 18 and terminates in a wing 28. The bolt 24 can be hand-tightened to fix the position of the bed 22 along the U-shaped support 12.

Figure 3:
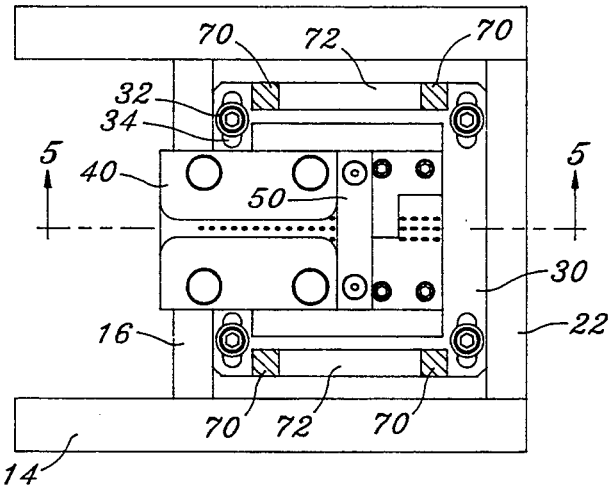
FIG. 3 is a top plan view of the knife and cutter assembly with the legs sectioned.

The bed comprises bottom plate 22 and upper plate 30 secured flat against the top surface of the bottom plate 22 and is laterally adjustable thereon by bolts 32. Bolts 32 extend upward from the bottom plate through slots 34 formed in the four corners of the upper plate 30 (FIG. 3).

Figure 5:
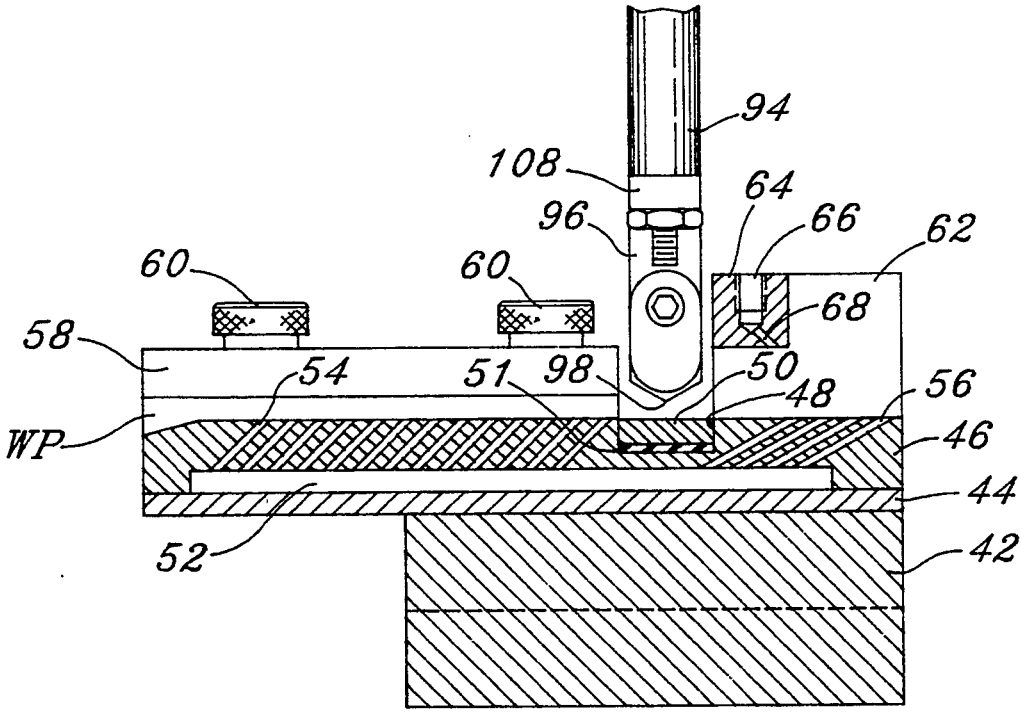
FIG. 5 is a fragmentary view of the knife and cutter assembly, partly in section to show the air distribution.

Fixedly supported on the center of the top plate 30 is the web guide and cutting block assembly 40. It includes (FIG. 5) a spacer block 42 secured directly to the top plate 30.

Figure 2:
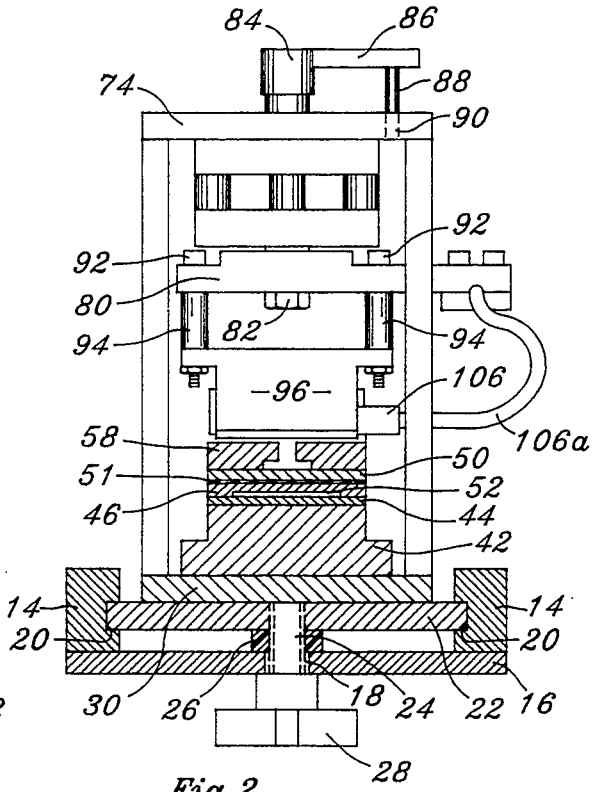
FIG. 2 is a front view with the knife and cutter assembly bed and support in section through the vertical plane of the knife.

Superposing the spacer block 42 is a manifold cover 44 to the top of which is mounted the guide block 46. Guide block 46 is formed with a transverse recess 48 which carries a metal cutting block or stick 50 bolted as shown to the guide block (FIG. 3). A resilient layer 51 immediately underlies the cutting block 50 as shown in FIG. 2 for the purpose of accommodating small unevenness or misalignment of the blade as it contacts the metal cutting block. The underside of the guide block 46 is provided with a broad recess or manifold 52 which communicates with slanting air vents 54, 56 on either side of the cutting stick recess 48. Removable overhanging web guide sides 58 are symmetrically provided on either side of the web path WP and are secured to the guide block 46 by thumb screws 60. An air connection (not shown) to the manifold permits web-conveying air to be blown out the vents 54, 56.

The downstream side of the web path WP is provided on one side with an air nozzle support 62 having an angled outlet 68. Air may be supplied therethrough to move on the severed piece.

Extending upward from the upper plate 30 are a plurality of support legs 70, pairs of which are joined at their lower ends by bridge elements 72. To the top of the support legs 70 is secured a motor support 74.

A motor in the form of a pneumatic cylinder 76 is secured to the underside of the motor support 74 and contains a piston (not shown) mounted on a connecting rod 78 to the lower end of which is secured a transverse yoke 80 by a nut 82. Extending upward from the center of the cylinder is the upper end of the connecting rod on which is mounted the boss 84 having an outward arm 86. The outer end of the arm carries a downward pin 88 which fits in an opening 90 in the top plate 74. The arm 86, pin 88 and opening 90 serve to keep the yoke 80 properly oriented with respect to the structure as the piston moves up and down.

A pair of bolts 92 extend downward through openings on the opposite ends of the yoke 80 respectively and pass through spacers 94.

Figure 4:
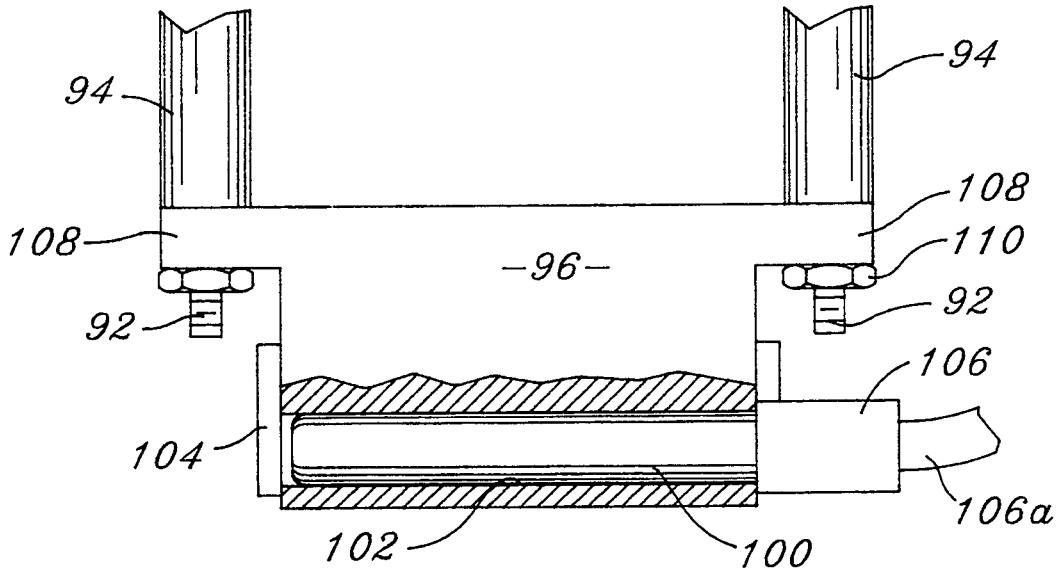
FIG. 4 is an enlarged fragmentary view, partly broken away, of the knife and its mounting as viewed from the right side.

A flat knife body 96 provides a cutting edge 98 along its lower end. The knife is not sharply pointed; instead the sides 98*c* and 9 of the cutting edge are at an obtuse angle (FIG. 4). The blade of the knife as defined by the sides 98*a*, 98*b* is symmetrical (FIG. 5) about an imaginary vertical line drawn through the knife point or cutting line 98. Because the angle between the sides is obtuse (i.e., the sides are greater than 45° away from the vertical) the sides are less than 45° with respect to the horizontal cutting block. This results in an area of impact on the fabric adjacent the cut as will be described.

The knife body is formed with a recess 100 above the cutting edge. The recess receives a Calrod 102. The recess 100 is provided with a cover 104 at one end, and the Calrod connector 106 is secured at the other end. Calrod power line 106*a* leads to a power supply.

At the upper end of the knife body 96 ears 108 extend laterally and are apertured to receive the bolts 92 which are nutted at 110, securing the assembly together.

As a result of the structure shown, the heat generated by the Calrod 102 effectively heats the cutting edge 98 thereadjacent. Because the knife body is supported only by the lateral ears which are of relatively small mass and remote from the Calrod, only a minimum of heat is conducted away through the bolts 92 and spacers 94. The arrangement is thus very efficient in that heat is delivered precisely where it is needed and for the most part not drawn away by conducting parts of the apparatus. The Calrod is preferably of the size that will heat the knife up to 950° F.

The operation of the structure is self-evident. Means, not shown, convey the endless web from a supply into the path WP and when a finite length is measured out by means not shown the cylinder is activated driving the heated knife 96 downward to make the cut. With the combination of the heat and impact of the knife, the threads in the synthetic fabric adjacent the cut bind together and preclude any fraying or unraveling.

Once the cut is made, the cylinder raises the yoke 80 and knife body 96 ready for the next cycle.

The invention is not limited to the embodiment shown but may be instead defined by the scope of the following claim language, expanded by an extension of the right to exclude as is appropriate under the Doctrine of Equivalents.

What is claimed is:

1. In combination:

a. an endless web of synthetic fabric, b. a severing apparatus comprising:

1. a bed having guide means for guiding the web on a path through the apparatus and having a flat metal cutting block disposed horizontally in the bed transverse to the path, the block being directly underlaid by a layer of resilient material,
2. support means secured to the bed and extending upward on opposite sides of the path,
3. vertically reciprocating drive means mounted on the support means above the block and comprising a vertically disposed pneumatic cylinder having a piston operatively disposed therein, a connecting rod connected thereto and extending through a sealed opening in the lower end of the cylinder, a horizontally disposed yoke secured at its center to the lower end of the rod,
4. vertically disposed support pins secured to and extending down from the opposite ends of the yoke, and
5. a heated knife assembly comprising a thin vertically disposed body having securing means at the opposite ends of the upper portion thereof secured to the pins respectively, a heating element disposed in the assembly, the lower end of the assembly comprising a heated knife being pointed in a cutting line parallel to the top surface of the cutting block, the converging sides of the heated knife at the cutting line being symmetrical about an imaginary vertical line through the cutting line and disposed at an obtuse angle with respect to each other so that the sides are at angles to the cutting block of less than 45° respectively, the heating element being parallel to the cutting line and adapted to heat the knife to a temperature approaching 950° F.

whereby when the drive means is activated, it will drive down the knife assembly so that the cutting line forcefully impacts the synthetic fabric and severs it and binds together the threads in the synthetic fabric adjacent the cut and creates non-fraying edges, the edges having been subject to the broad impact of the sides of the heated knife at an angle of less than 45° to the cutting block.

2. The combination as claimed in claim 1 wherein the bed has compressed air passages therein having angled outlets in the path to help move the web and finite lengths along the path.

3. The combination as claimed in claim 1 wherein a support frame supports the bed in an adjustably fixed manner lengthwise of the path.

4. The combination as claimed in claim 3 wherein the bed is laterally adjustable with respect to the frame.

* * * * *